United States Patent [19]

Howie et al.

[11] 4,033,028

[45] July 5, 1977

[54] METHOD OF MAKING HEATING CABLES

[75] Inventors: David Malcolm Howie, Carrying Place; Roy Victor W. McKenzie, Belleville; James Ronald Snape, Brighton, all of Canada

[73] Assignee: Pyrotenax of Canada Limited, Trenton, Canada

[22] Filed: Apr. 22, 1976

[21] Appl. No.: 679,325

Related U.S. Application Data

[62] Division of Ser. No. 587,161, June 16, 1975, Pat. No. 4,001,760.

[30] Foreign Application Priority Data

June 21, 1974 United Kingdom ..... 27623/74

[52] U.S. Cl. ..... 29/611; 29/616

[51] Int. Cl.[2] ..... H05B 3/18

[58] Field of Search ..... 29/611, 613–616; 174/102, 118; 338/30, 214, 226, 238, 239, 240, 243, 271; 219/544, 552, 553, 546, 548, 549

[56] References Cited

UNITED STATES PATENTS

| | | | |
|---|---|---|---|
| 2,808,492 | 10/1957 | Yohe | 29/611 X |
| 2,905,919 | 9/1959 | Lorch et al. | 338/238 X |
| 3,017,688 | 1/1962 | Cummings et al. | 29/616 |
| 3,350,544 | 10/1967 | Lennox | 219/553 X |
| 3,397,302 | 8/1968 | Hosford | 219/544 X |
| 3,757,086 | 9/1973 | Indoe | 219/549 X |
| 3,809,803 | 5/1974 | Helmcke et al. | 338/214 X |
| 3,859,506 | 1/1975 | Weckstein | 219/552 |
| 3,861,029 | 1/1975 | Johannsen et al. | 338/214 X |

*Primary Examiner*—Victor A. DiPalma
*Attorney, Agent, or Firm*—Fetherstonhaugh & Co.

[57] ABSTRACT

A mineral insulated heating cable and a method of making same wherein the cable has the characteristic that for a given supply voltage the heat generated per unit length of the cable is substantially unaffected by the total length of the cable. The mineral insulated heating cable comprises at least two metallic conductors, a metallic protective sheath, a body of compacted mineral insulating material filling the sheath and spacing the conductors from one another and embedded in the compacted mineral insulating material and contacting each of the two said conductors throughout their lengths, at least one resistance element in the form of a thin layer consisting predominantly of resistive material. The method of making the mineral insulated electrical heating cable comprises the steps of forming an assembly consisting of two or more ductile metallic conductors, namely a surrounding sheath and at least one other conductor within it, and a multiplicity of preformed blocks of mineral insulating material, at least some of which carry coatings of resistive material, filling the remaining spaces within the sheath with the coatings individually or collectively contacting at least two of the conductors throughout the length thereof, and reducing the cross-section of the assembly to form the mineral insulating material into a homogeneous body of compacted insulating powder whilst maintaining at least one layer of resistive material individually or collectively contacting at least two of the conductors throughout the length thereof.

10 Claims, 7 Drawing Figures

METHOD OF MAKING HEATING CABLES

Figure 1:
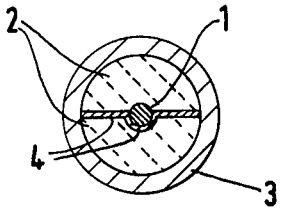

This is a division of application Ser. No. 587,161, now U.S. Pat. No. 4,001,760, filed June 16, 1975.

This invention relates to mineral insulated electric heating cables and to their manufacture. Such cables, as at present manufactured, rely on current flowing through longitudinally extending metallic resistance wires, which has the disadvantage that for a fixed supply voltage and thermal loading a given cable can only be used in one particular length.

Proposals have been made to overcome this difficulty by utilising the longitudinal conductors of a heating cable essentially as electrodes only and generating substantially all the heat in a resistive body in which the electrodes are at least partly embedded. An example can be found in Canadian Pat. No. 653,694 of British Insulated Callender's Cables Ltd., to which U.K. Pat. No. 832,503 and French Pat. No. 1,172,088 and U.S. Pat. No. 2,905,919 corresponds and a substantially identical proposal has been communicated to us by our employee Ernest Ulric McKenty, who devised it independently. So far as the Applicants are aware, however, such proposals have not hitherto led to the production of commercially satisfactory mineral insulated heating cables.

Such prior proposals depended on the use of particulate resistive material dispersed within mineral insulating material, and the Applicants believe that they failed because of the difficulty of producing such a dispersion with a sufficient uniformity to ensure sensibly uniform loading along the length of the cable and then maintaining the uniformity of the dispersion during the filling and reduction stages of cable manufacture.

In accordance with one aspect of the present invention, a mineral insulated electric heating cable having the characteristic that for a given supply voltage the heat generated per unit length of the cable is substantially unaffected by the total length of the cable comprises at least two longitudinally extending metallic conductors, a metallic protective sheath which may but need not constitute one of the said two conductors, a body of compacted mineral insulating material filling said sheath and spacing the said conductors from one another, and embedded in the compacted mineral insulating material and contacting each of the two said conductors throughout their lengths at least one resistance element in the form of a thin layer consisting predominantly of resistive material.

Preferably the or each resistance element consists as nearly as possible wholly of the resistive material, but admixture of a minor amount of insulating powder is probably inevitable and is acceptable provided that large numbers of continuous cnductive paths exist from conductor to conductor through the resistance element.

Normally it is preferable for the or each resistance element to contact each of the metallic conductors continuously throughout its length, but discontinuous contact might be used to attain a very low loading if desired.

The preferred resistive materials are the so-called semi-conductive materials, especially conductive carbon powder.

If the metallic protective sheath constitutes one of the conductors, it is preferably externally insulated. Plastics material may be used for this purpose. In other cases external insulation may be provided if desired or if the circumstances of installation make it necessary.

In accordance with another aspect of the invention, a method of making a mineral insulated electric heating cable having the characteristic that for a given supply voltage the heat generated per unit length of the cable is substantially unaffected by the total length of the cable comprises: forming an assembly comprising two or more ductile metallic conductors, namely a surrounding sheath and at least one other conductor within it, at least one layer or resistive material supported by a carrier and individually or collectively contacting at least two of the conductors throughout the length thereof, and mineral insulating material filling the remaining space within the sheath; and reducing the cross-section of the assembly to form the mineral insulating material into a homogeneous body of compacted insulating powder whilst maintaining at least one layer of resistive material individually or collectively contacting at least two of the conductors throughout the length thereof.

The carrier for the layer of resistive material may be a continuous flexible tape of a material compatible with the reduction process. The preferred carrier tape material is paper, which can be destroyed by a heat treatment in the early stages of the reduction process. Suitably chosen textile tapes could be used in the same way, and it might be possible to use a glass fibre carrier tape that would fragment in the reduction process. The resistive material may be coated on a surface of the carrier tape or it may be impregnated into a thin porous carrier tape provided that it will form a continuous layer in the finished cable.

The assembly may be formed by any of the techniques used for manufacture of mineral insulated cables, but to minimize the risk of insulating powder penetrating between the resistive layer and the metallic conductors it is preferable to select a method in which preformed blocks of insulating material, for example discrete blocks pressed from moist magnesium oxide, are used. For a given conductor geometry a suitable shape for the blocks may be arrived at by sub-dividing the shape used for a conventional mineral insulated cable to provide suitable contiguous surfaces between which the resistive material may be inserted.

When such preformed blocks are used they may themselves serve as the carrier, instead of a separate continuous flexible tape; in this case the resistive coating will be applied directly onto an appropriate surface or surfaces of each, or at least some, of the blocks. The invention includes coated preformed blocks.

The resistive coating may be applied to the carrier or carriers by dipping in aqueous colloidal graphite (such as is sold under the trade mark "Aquadag "). Thickness (and hence for any particular reduction the power developed per unit length) can be regulated by regulating the exposure time and/or concentration of the bath. Preferably the or each carrier is dried after coating and before assembly.

A further possibility is to introduce the resistive material by using a "carrier " which in its initial state has not the appropriate electrical properties but which acquires those properties during the annealing process. It may, for example, be a textile tape which burns during the annealing process to produce sufficient carbon to provide a thin layer of resistive material forming the resistance element. Different thicknesses or weights of textile tape would be selected in accordance with the resistive value required.

However the resistive layer is introduced, the rating of a cable made from the same workpiece can be varied by varying the degree of reduction to which it is submitted to form the final cable.

The reduction process (swaging, rolling and/or drawing) may follow conventional mineral insulated cable practice.

Figure 5:
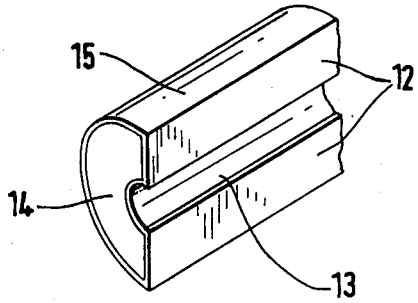
Figure 6:
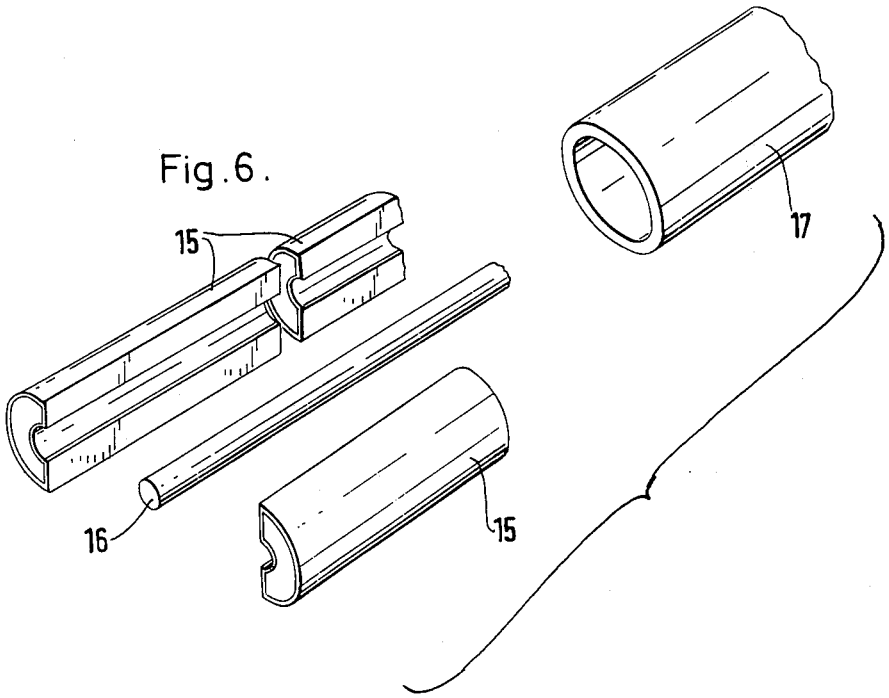
Figure 7:
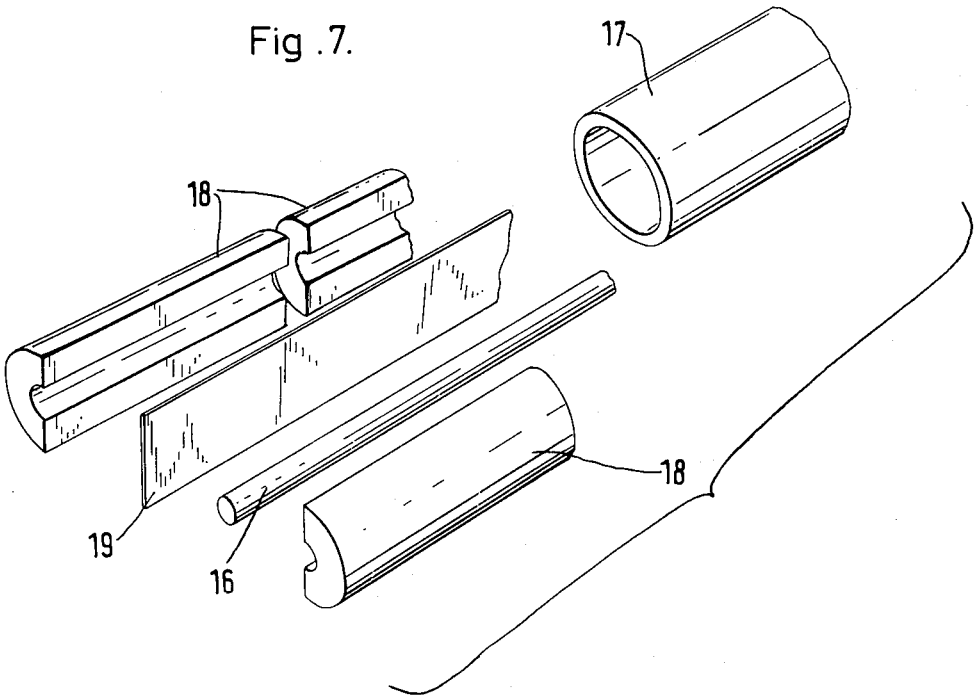

The invention will be further described, by way of example, with reference to the accompanying drawings in which FIGS. 1–4 are cross-sections of four types of cable in accordance with the invention;

FIG. 5 is a perspective view of a coated insulating block used in some forms of the invention; and FIGS. 6 and 7 are diagrams illustrating the manufacture of the cable of FIG. 1 by two alternative methods.

FIG. 1 shows a simple form of cable in accordance with the invention and comprising a central conductor 1 with mineral insulation 2 and an outer tube 3 which acts both as a load-carrying conductor and as a sheath. Embedded in the mineral insulation 2 is a thin layer of graphite 4 which is in continuous contact with both the conductors 1, 3 throughout the length of the cable.

Figure 2:
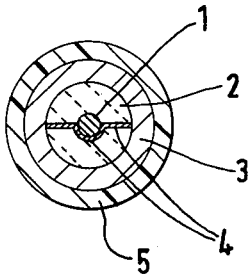

FIG. 2 shows the same cable with an insulating and protective plastics jacket 5 added.

Figure 3:
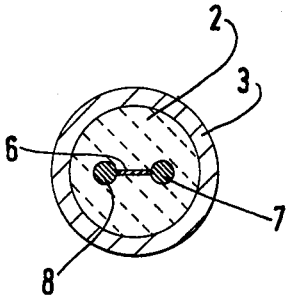

FIG. 3 shows an alternative design in which the graphite resistance element 6 connects two separate conductors 7, 8 both embedded in the insulation 2 so that the metal sheath 3 does not carry load current. A protective plastics jacket can be added if desired.

Figure 4:
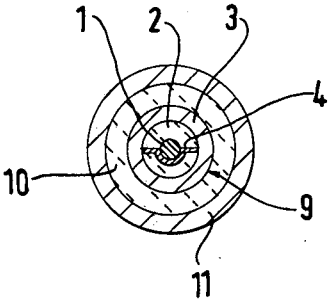

FIG. 4 shows a further design in which an inner assembly 9 that is identical with the cable of FIG. 1 is enclosed in a further layer of mineral insulation 10 and an outer metal sheath 11. This can be regarded as a high-temperature version of the cable shown in FIG. 2.

In a preferred method of manufacture, moist magnesium oxide blocks are pressed, as in one conventional method of manufacturing mineral insulated cable save that they are made semi-annular instead of annular, and are dried. The blocks are coated at least on the longitudinal flat surface 12 (FIG. 5) and part of the inner concave surface 13 by dipping in a colloidal graphite suspension. In fact it has been found convenient to immerse the blocks completely, so coating all the surfaces, and to scrape off the coating from the end faces 14 after drying but to leave the external convex surface 15 coated. The blocks are then assembled with a copper rod 16 (FIG. 6) and a copper tube 17 and the assembly is reduced by a conventional mineral-insulated cable manufacturing technique to form the cable of FIG. 1.

FIG. 7 illustrates the alternative method of manufacture in which uncoated semi-annular blocks 18 are assembled about the conductor 16 with a strip 19 of carbon-impregnated paper or fabric interposed between them. The assembly is reduced as before, the paper or fabric carbonising when the drawn assembly is annealed.

EXAMPLE 1

A coating bath is made up by mixing 1 part of a 35percent-solids aqueous colloidal molybdenum disulphide dispersion (Dag. 181) with 10 parts of a 34 to 38percent-solids aqueous colloidal dispersion (Dag. 206) and 100 parts additional water (parts being by volume) and agitating for 5 minutes on a standard Waring blender. The two colloidal dispersions are commercially available from Acheson Colloids Co. of Port Huron, Mich. USA who are believed to be proprietors of the trade mark SAG '.

Using the method illustrated by FIG. 6, semi-annular magnesium oxide blocks with external and internal raddi of 5.3 mm (0.210 inches) and 1.3 mm (0.050 inches) respectively and a length of 51 mm (2 inches) are dried by heating at 200° C (400° F for 15 minutes, cooled, dipped for 1 minute in the coating bath and dried in the air. After cleaning their ends, the blocks are assembled with a copper rod 2.54 mm (0.100 inches) in diameter in a copper tube with an outer diameter of 16.5 mm (0.65 inches) and a wall thickness of 1.6 mm (0.0625 inches). The assembly is drawn to 5.7 mm (0.223 inches) diameter and annealed for 4 hours at 400° C (750° F).

This produces a cable with a power loading of 16 watt/m (5 watts per foot) at 115 volts for any length from a few centimeters to several hundred meters. The loading can be increased (or decreased) by increasing (or decreasing) the proportion of graphite in the coating bath or, if diameter changes are acceptable, by varying the reduction.

EXAMPLE 2

A tape made of cellulosic paper is coated and impregnated with graphite by immersing in a colloidal graphite bath. After drying the tape is assembled as shown in FIG. 7 with a central copper conductor preformed semi-annular magnesia blocks and a copper sheath with an external diameter of 15.9 mm.

The assembly is first drawn through a single die to a diameter of 12.1 mm to crush the blocks of insulating material and fill any void spaces, and is then heated to 500° C to anneal the copper components and carbonise the paper. The assembly is then further reduced by conventional mineral insulated cable manufacturing technique to a finished external diameter of 3.2 mm; a plastics insulation may be applied overall. The finished cable develops a uniform power for any length of cable from a few centimeters up to several hundred meters.

9n

The embodiments of the invention in which an exclusive property or privilege is claimed are defined as follows:

1. A method of making a mineral insulated electric heating cable, having the characteristic that for a given supply voltage the heat generated per unit length of the cable is substantially unaffected by the total length of the cable, comprising: forming an assembly comprising two or more ductile metallic conductors, namely a surrounding sheath and at least one other conductor within and spaced from it, at least one thin layer consisting of predominantly resistive material, which does not include an admixture of any significant amount of insulating material, supported by a carrier and individually or collectively contacting at least two of the conductors throughout the length thereof, and mineral insulating material substantially filling the remaining space within the sheath; and reducing the cross-section of the assembly to form the mineral insulating material into a homogeneous body of compacted insulating powder completely filling the remaining space whilst maintaining at least one layer of resistive material individually or collectively contacting at least two of the conductors throughout the length thereof.

2. A method of making a mineral insulated electric heating cable, having the characteristic that for a given supply voltage the heat generated per unit length of the cable is substantially unaffected by the total length of the cable, comprising: forming an assembly comprising two or more ductile metallic conductors, namely a surrounding sheath and at least one other conductor within and spaced from it, and a multiplicity of preformed blocks of mineral insulating material, at least some of which carry coatings of predominantly resistive material which does not include an admixture of any significant amount of insulating material, said preformed blocks of insulating material substantially filling the remaining space within the sheath with said coatings individually or collectively contacting at least two of the conductors throughout the length thereof; and reducing the cross-section of the assembly to form the mineral insulating material into a homogeneous body of compacted insulating powder completely filling said remaining space whilst maintaining at least one layer of resistive material individually or collectively contacting at least two of the conductors throughout the length thereof.

3. A method as claimed in claim 2 in which the preformed blocks are semi-annular.

4. A method as claimed in claim 1 in which the carrier is a continuous flexible tape of a material compatible with the reduction process.

5. A method as claimed in claim 1 in which the resistive material is coated on the surface of the carrier.

6. A method as claimed in claim 1 in which said carrier is coated by dipping in aqueous colloidal graphite.

7. A method as claimed in claim 6 comprising drying the carrier after coating and before assembly.

8. A method of making a mineral insulated electric heating cable, having the characteristic that for a given supply voltage the heat generated per unit length of the cable is substantially unaffected by the total length of the cable, comprising: forming an assembly comprising two or more ductile metallic conductors, namely a surrounding sheath and at least one other conductor within and spaced from it, at least one thin layer consisting of predominantly resistive material, which does not include an admixture of any significant amount of insulating material, supported by a carrier in the form of a flexible paper tape and individually or collectively contacting at least two of the conductors throughout the length thereof, and mineral insulating material substantially filling the remaining space within the sheath; and reducing the cross-section of the assembly to form the mineral insulating material into a homogeneous body of compacted insulating powder completely filling the remaining space whilst maintaining at least one layer of resistive material individually or collectively contacting at least two of the conductors throughout the length thereof.

9. A method of making a mineral insulated electric heating cable, having the characteristic that for a given supply voltage the heat generated per unit length of the cable is substantially unaffected by the total length of the cable, comprising: forming an assembly comprising two or more ductile metallic conductors, namely a surrounding sheath and at least one other conductor within and spaced from it, at least one thin layer consisting of predominantly resistive material, which does not include an admixture of any significant amount of insulating material, supported by a carrier in the form of a textile tape and individually or collectively contacting at least two of the conductors throughout the length thereof, and mineral insulating material substantially filling the remaining space within the sheath; and reducing the cross-section of the assembly to form the mineral insulating material into a homogeneous body of compacted insulating powder completely filling the remaining space whilst maintaining at least one layer of resistive material individually or collectively contacting at least two of the conductors throughout the length thereof, said textile tape being destroyed by a heat treatment in the early stages of the production process.

10. A method as claimed in claim 1 wherein said mineral insulating material is in the form of a multiplicity of preformed blocks prior to the reduction of the cross-section of the assembly.

* * * * *